US007967177B2

(12) United States Patent
Sperrfechter et al.

(10) Patent No.: US 7,967,177 B2
(45) Date of Patent: Jun. 28, 2011

(54) COMBUSTION-OPERATED SETTING TOOL

(75) Inventors: Thomas Sperrfechter, Gruesch (CH); Tilo Dittrich, Grabs (CH); Riccardo Morel, Chur (CH)

(73) Assignee: Hilti Aktiengesellschaft, Schaan (LI)

( * ) Notice: Subject to any disclaimer, the term of this patent is extended or adjusted under 35 U.S.C. 154(b) by 128 days.

(21) Appl. No.: 12/317,277

(22) Filed: Dec. 19, 2008

(65) Prior Publication Data

US 2009/0159635 A1 Jun. 25, 2009

(30) Foreign Application Priority Data

Dec. 21, 2007 (DE) ..... 10 2007 055 904

(51) Int. Cl.
*B25C 1/08* (2006.01)

(52) U.S. Cl. ..... 227/10; 227/9; 227/130

(58) Field of Classification Search ..... 227/9, 10, 227/129, 130
See application file for complete search history.

(56) References Cited

U.S. PATENT DOCUMENTS

| | | | | | |
|---|---|---|---|---|---|
| 4,403,722 | A | * | 9/1983 | Nikolich | 227/8 |
| 4,483,280 | A | * | 11/1984 | Nikolich | 123/46 SC |
| 4,483,474 | A | * | 11/1984 | Nikolich | 227/8 |
| 4,721,240 | A | * | 1/1988 | Cotta | 227/10 |
| 5,090,606 | A | * | 2/1992 | Torii et al. | 227/10 |
| 5,197,646 | A | * | 3/1993 | Nikolich | 227/8 |
| 5,680,980 | A | * | 10/1997 | Robinson | 227/10 |
| 5,909,836 | A | * | 6/1999 | Shkolnikov et al. | 227/8 |
| 5,971,245 | A | * | 10/1999 | Robinson | 227/10 |
| 2004/0173657 | A1 | | 9/2004 | Turk | |
| 2009/0032563 | A1 | | 2/2009 | Yokochi | |

FOREIGN PATENT DOCUMENTS

| | | | |
|---|---|---|---|
| EP | 0123716 | A2 | 11/1984 |
| WO | WO 2007/058713 | A1 | 5/2007 |

* cited by examiner

*Primary Examiner* — Brian D Nash
(74) *Attorney, Agent, or Firm* — Abelman, Frayne & Schwab

(57) ABSTRACT

A combustion-operated setting tool (10) for driving in fastening elements, includes a combustion chamber (15), a ventilator (16), and a motor (17) for driving the ventilator (16). The motor (17) is mounted in a receptacle (20) of a motor-supporting member (21) and is supported at least at one of its axial ends (24, 25) by an annular damping element (30) at a wall portion (22, 23) defining the receptacle (20), with an annular recess (33) arranged at the circumference of the annular damping element (30).

11 Claims, 6 Drawing Sheets

COMBUSTION-OPERATED SETTING TOOL

BACKGROUND OF THE INVENTION

1. Field of the Invention

The present invention relates to a combustion-operated setting including a combustion chamber, a ventilator located in the combustion chamber, and a motor for driving the ventilator and received in a receptacle of a motor supporting member and supported, at least at one of its axial ends, by an annular damping element.

2. Description of the Prior Art

Setting tools of the type mentioned above can be operated, e.g., with gaseous or vaporizable liquid fuels. In combustion-operated setting tools, a setting piston is driven by expanding combustion gases in the setting process. Fastening elements can then be driven into a substrate by means of this setting piston. Prior to a combustion process, the fuel is mixed with the air located in the combustion chamber by a fan or ventilator which is located in the combustion chamber. The fan is driven by a motor, preferably an electric motor. The forces occurring during a setting process lead to high accelerations of the setting tool. Also, large accelerations occur in cases of improper use when the energy of the setting piston must be absorbed entirely by the setting tool. These accelerations have a negative impact on the life of the fan motor.

A combustion-operated setting tool of the generic type with a combustion chamber and a ventilator arranged in the combustion chamber is disclosed in International Publication WO 2006/106866. The ventilator can be driven by a motor which is arranged in a receptacle in a rear wall of the combustion chamber. Annular damping elements which damp movements of the motor along its longitudinal axis are arranged between the two axial ends of the motor and the respective wall portions of the receptacle which are located opposite from the motor.

While it is true that the damping elements known from WO 2006/106866 damp occurring peak loads, it takes a relatively long time before the damping system is again at rest once it has been excited and set in oscillation. This kind of after-oscillation of the motor damping system means an increased alternating load for the motor, which shortens its life.

SUMMARY OF THE INVENTION

It is the object of the present invention to provide a combustion-operated setting tool of the type mentioned above in which an oscillation of the motor is reduced to a minimum by the damping system.

This and other objects of the present invention, which will become apparent hereinafter, are achieved by providing an annular recess in the circumference of the annular damping element.

The force characteristic of a damping element formed in this way exhibits an advantageously marked hysteresis. Because of this hysteresis and a friction at the inner surfaces of the annular recess in the compressed state of the damping element, the energy stored by the deformation of the damping element is only partially converted into work again. The proportion that is not converted again is dissipated in the damping element. Accordingly, an excited oscillation stops faster than in a damping element without a circumferential annular recess. Therefore, the motor which is damped by the damping element according to the invention returns to its quiescent position faster so that its life is increased. By "annular" is meant not only round and elliptical annular shapes, but also polygonal annular shapes.

In this connection, it is advantageous when the annular recess is arranged at the inner circumference of the annular damping element so that an optimal deformation behavior of the damping element is achieved.

An optimal design of the damping element is achieved when a cross-sectional surface area of the annular recess makes up 20% to 60%, preferably 25% to 50%, of a total cross-sectional surface area of the damping element.

The annular recess advantageously has a U-shaped cross section so that when the damping element is compressed there is always a closed interior space within which air can be captured, which works to the advantage of the damping characteristics of the damping element. The U-legs need not necessarily extend in a straight line in cross-section; they can also extend in a bulging manner or so as to curve outward (with respect to the interior).

Further, it is advantageous when a radial depth of the annular recess is less than an axial width of the annular recess so that the design of the damping element is further improved.

In an advantageous manner, an annularly circumferentially extending projection is arranged at least at a first axial front side of the damping element adjacent to an annular opening of the damping element and forms a sealing lip which seals relative to the contacting wall portion or relative to the motor. In this respect, when the annular recess is arranged at the inner circumference of the annular damping element, the circumferential projection forms a fulcrum which impresses a directed movement on the damping element during a compressive process and reinforces a closing of the annular recess. A projection or sealing lip of this kind could also be provided additionally at the second front side located opposite from the first front side of the damping element. The diameter of the annular projection or sealing lip is less than the radial depth or than the outer diameter of the annular recess.

Further, it is advantageous when a flange portion is arranged at an axial end of the damping element located opposite from the first axial front side, which flange portion extends around the outer circumference of the damping element. This flange portion advantageously serves as a centering support of the damping element relative to a wall of the motor-supporting member, which wall surrounds the damping element. In so doing, the flange portion ensures the necessary free space required by the damping element during a compressive process.

Further, it is advantageous when the motor is supported at both axial end areas in the receptacle by a damping element in each instance so that an optimal damping of the motor is achieved.

Further, it is advantageous when the first front side of the damping element at which the annular projection (or sealing lip) is arranged faces the axial end area of the motor so that sealing is carried out at least relative to the motor.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
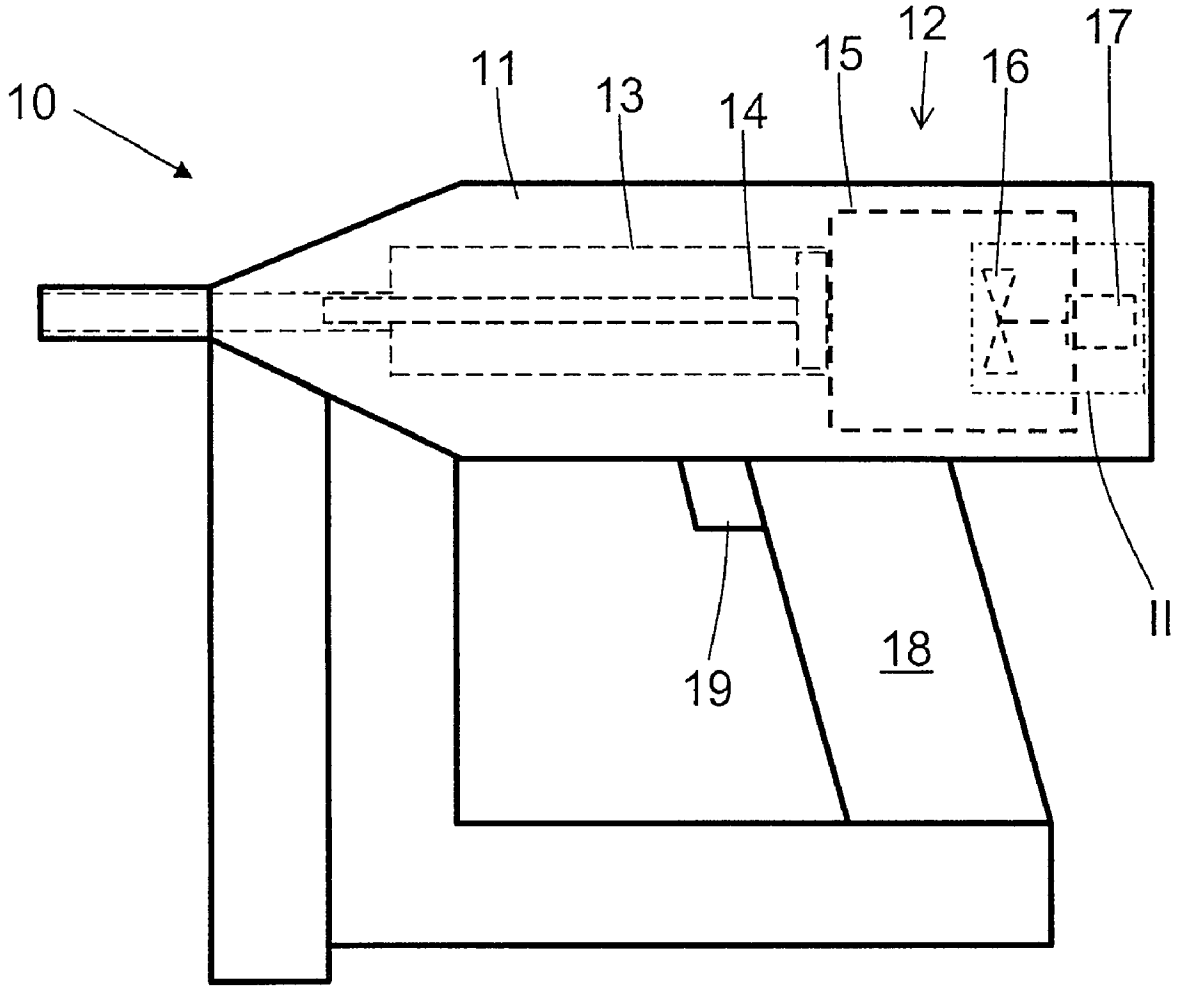
FIG. 1 a schematic side view of a combustion-operated setting tool according to the invention.

A hand-held combustion-operated setting tool 10 according to the present invention which is shown in FIGS. 1, 2 and 4*a* to 4*d*, has a housing formed of one or more parts and designated in its entirety by a reference numeral and 11 in which a drive 12 is arranged. A fastening element such as a nail, bolt, etc., can be driven into a workpiece by the drive 12. The fastening elements can be stored, e.g., in a cartridge at the setting tool 10.

The drive includes a combustion chamber 15 and a guide cylinder 13 in which a setting piston 14 is arranged so as to be axially displaceable. As can further be seen from FIG. 1, a trigger switch 19 is arranged at a handle 18 of the setting tool 10 and triggers a firing device, not shown in FIG. 1, e.g., a spark plug located in the combustion chamber 15 when the setting tool 10 has been pressed against a workpiece. In addition to the trigger switch 19 mentioned above, additional switches such as, e.g., contact pressure switch, combustion chamber switch and/or cartridge switch can also be provided.

The setting tool 10 can be operated with a combustion gas or with a vaporizable liquid fuel which is provided in a fuel reservoir, not shown in FIG. 1, e.g., a fuel canister.

A ventilator 16 which is arranged in the combustion chamber 15 and can be driven by a motor 17 serves to generate a turbulent flow regime of an oxidant/fuel mixture that fills the closed combustion chamber 15 and to flush out the open combustion chamber 15 with fresh air after a setting process.

An electric energy source, e.g., a battery, is provided for supplying the electrical consumers, e.g., the firing device and the motor 17, with electrical energy.

Figure 2:
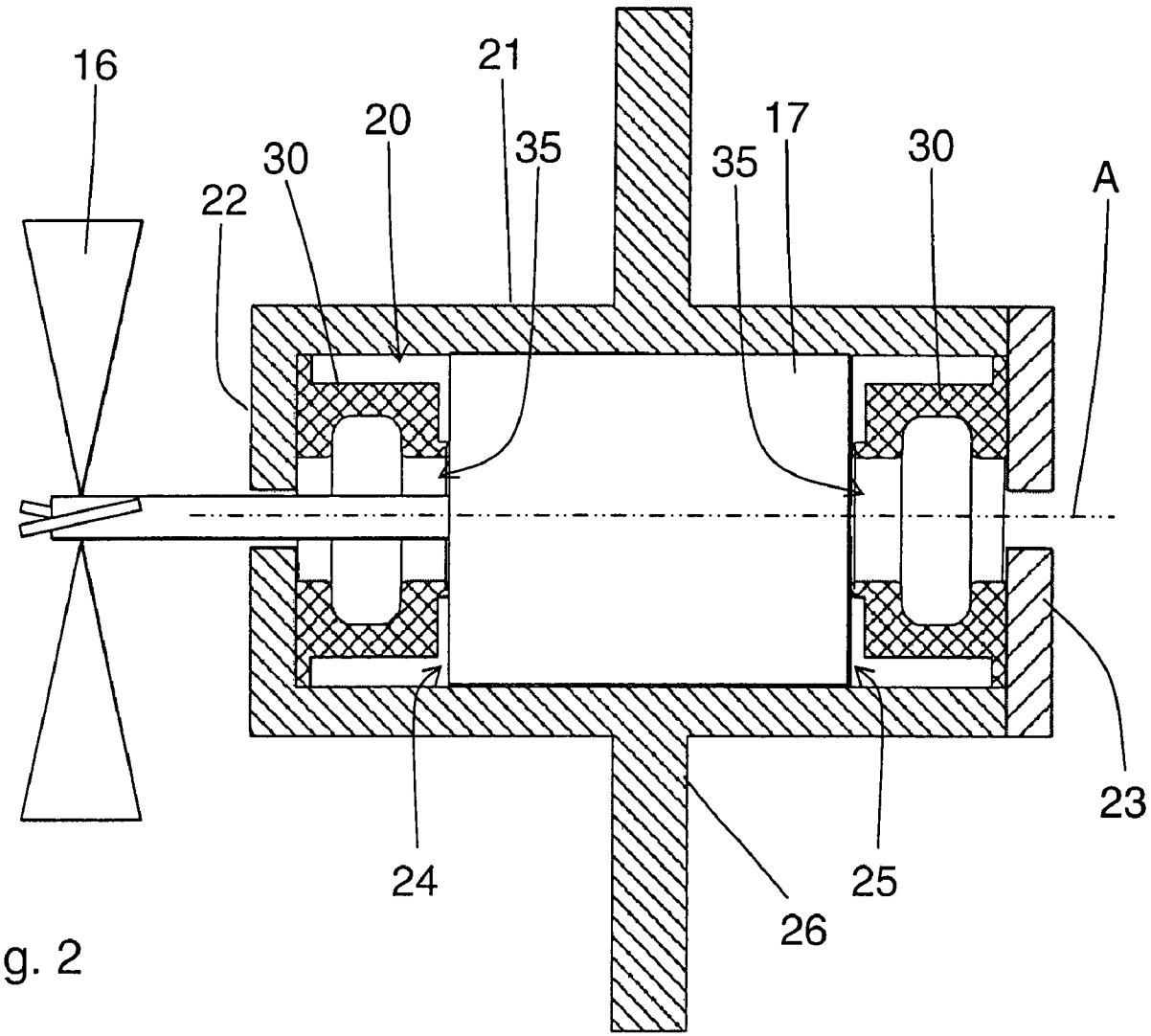
FIG. 2 a detail of the setting tool designated with a reference sign II in FIG. 1.

The motor 17 is mounted in a receptacle 20 of a motor-supporting member 21 which is formed integrally with a combustion chamber rear wall 26 (only a section of which is shown in FIG. 2) in the embodiment shown in FIG. 2. In this connection, the combustion chamber rear wall 26 can function as a closure for an axially displaceable combustion chamber sleeve. The motor 17 is supported at its first axial end area 24 and its second axial end area 25, respectively, by an annular damping element 30 at the first and second wall portions 22, 23 defining the receptacle 20. In this case, "axial" refers to the axis A which is defined by the longitudinal extension of the motor 17, the annular damping elements 30 also being arranged substantially coaxially with the axis A.

The damping elements 30 have a continuously circumferential annular recess 33 on the radial inner side, which recess 33 is U-shaped in cross-section. The radial depth T of the annular recess is less than its axial width B. In both of the damping elements 30, the cross-sectional surface area of the annular recess 33 is approximately 20% to 60%, preferably 26% to 50%, of the total cross-sectional surface of the damping element 30. An annularly circumferentially extending projection 34 formed as a sealing lip is arranged directly adjacent to the annular openings 35 of the damping elements 30 at first axial front sides 31 of the damping elements 30 which face the motor 17. This projection 34 extends past the respective front side 31 in the axial direction. On both damping elements 30, a flange portion 32, which extends circumferentially on the radial outer side, is arranged at an axial end of the damping element 30 located opposite from the first axial front side 31. The supporting surface of the damping elements 30 at the first wall portion 22 and at the second wall portion 23 is enlarged by the flange portion 32. Alternatively, the annular recess could also be arranged at the outer circumference of the damping elements, and the annular projection would then be arranged preferably on the radial outer side at the first axial front side (not shown in the drawings).

The motor 17 is accordingly located between the two damping elements 30 in the receptacle 20. The two damping elements 30 contact the motor 17 by their annular projections 34 and contact the wall portions 22, 23 by their other axial ends which are enlarged by the flange portions 32. The second wall portion 23 is formed by a cover part or closure means for the receptacle 20, while the first wall portion 22 is formed integrally with the motor-supporting member 21.

The operation of the damping elements 30 will be described by way of example of the damping elements 30 arranged between the motor 17 and the second wall portion 23 referring to FIGS. 4*a* through 4*d*. FIG. 4*a* shows the damping element 30 in its initial position in which it has not been subjected to deformation.

Figure 4B:
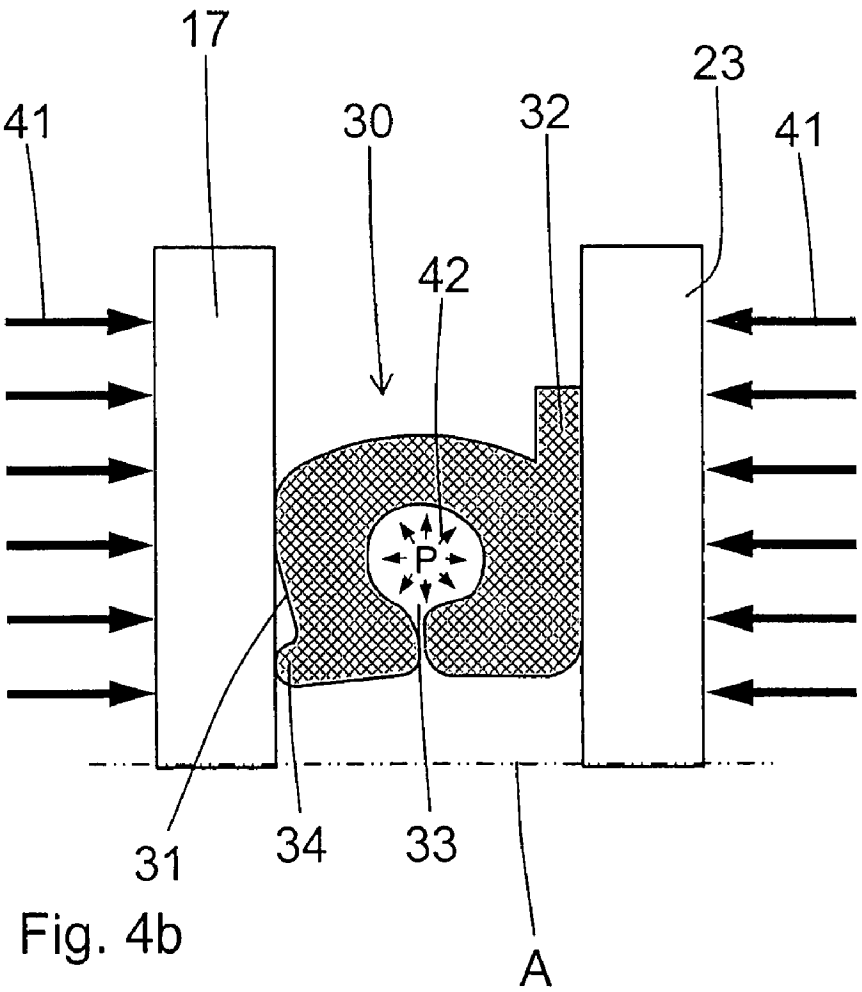
FIG. 4*b* a cross-sectional view of the damping element according to FIG. 4*a* during a loading phase.
Figure 4A:
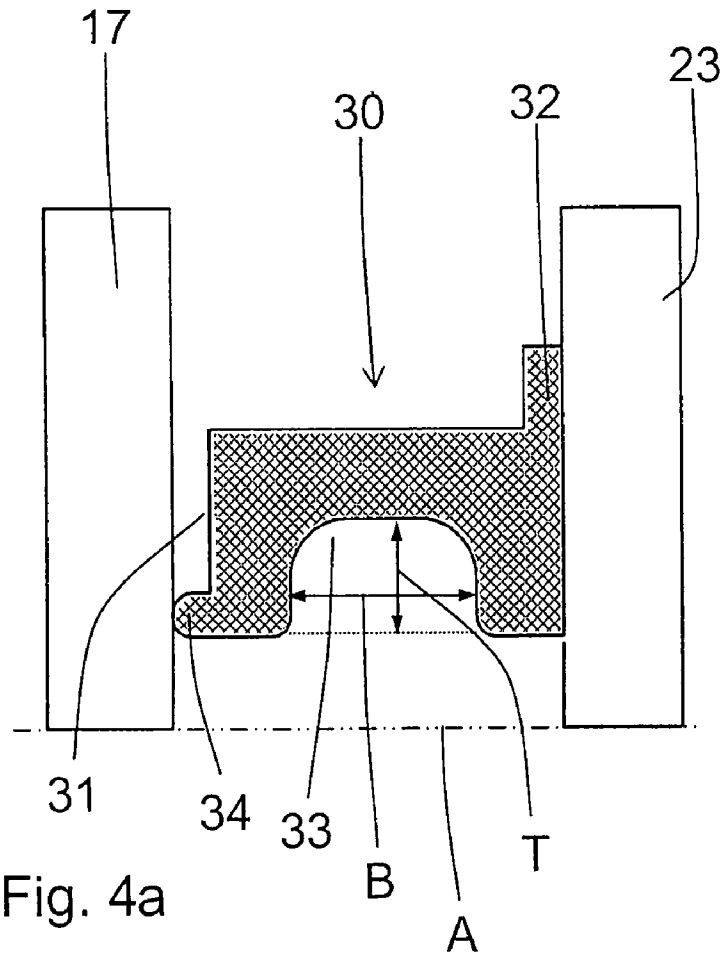
FIG. 4*a* a cross-sectional view of a damping element shown in FIG. 2 in unloaded position.

In FIG. 4*b*, after the setting process has been initiated, the damping element 30 is in a loading phase in which the damping element 30 is compressed between the motor 17 and the second wall portion 23 by the forces (indicated by the first arrow 41) acting on the latter. The interior of the annular recess 33 communicates with the surroundings only through a narrow annular gap. In this way, an overpressure P (indicated by the second arrow 42) is built up in the annular recess 33. This results in a sharper rise of force in the middle region of the compression path as is shown by the curve of the load force characteristic 51 shown in FIGS. 5*a* and 5*b*.

Figure 4D:
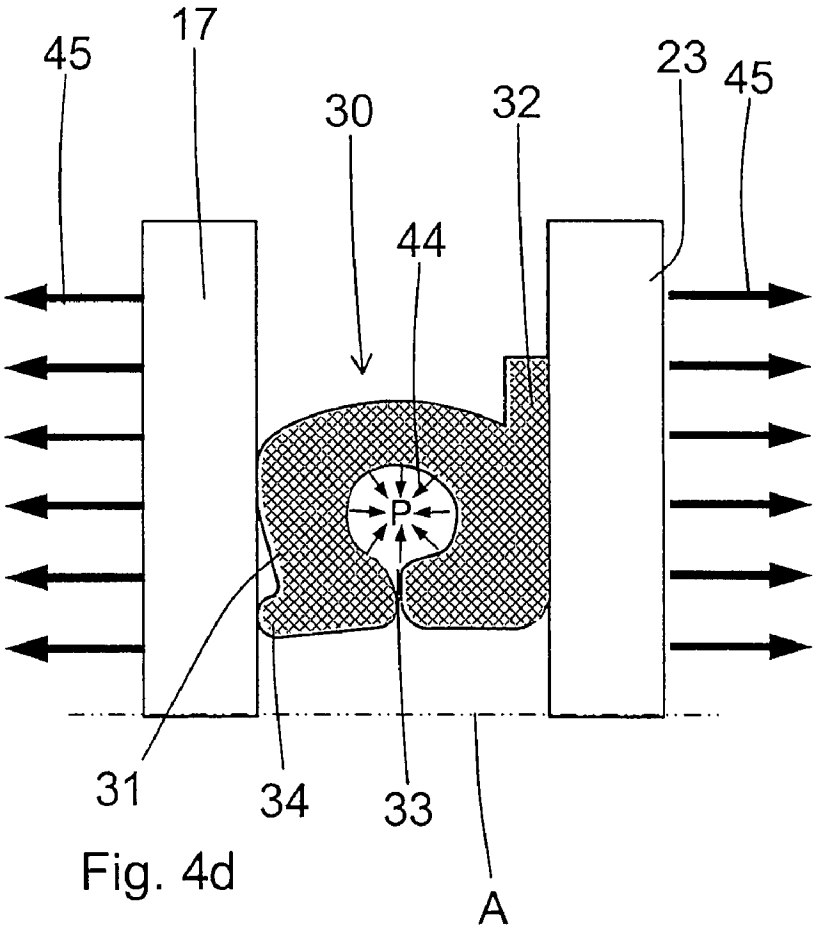
FIG. 4*d* a cross-sectional view of the damping element according to FIG. 4*a* during a load relieving phase.
Figure 4C:
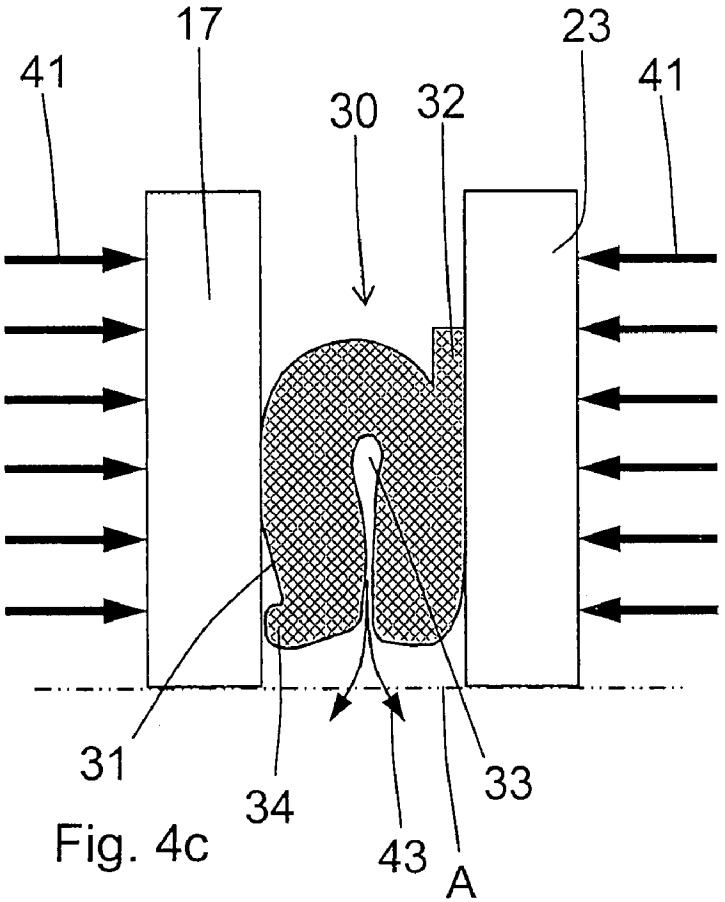
FIG. 4*c* a cross-sectional view of the damping element according to FIG. 4*a* in a highly compressed state.

In FIG. 4*c*, the damping element 30 has been highly compressed by the forces acting on it (shown by the first arrow 41); the inner surfaces of the annular recess 33 contact one another at least partially and the air is pressed outward through the gap (see third arrow 43). This leads to a small drop in force as can be seen from the shape of the load force characteristic line 51 (between approximately 2.25 mm and 3 mm path) in FIGS. 5*a* and 5*b*. Another increase in force occurs during a further compression of the damping element 30 when the inner surfaces contact one another almost completely, and there are also relative movements of the inner surfaces with respect to one another which cause friction.

In FIG. 4*d*, the damping element 30 is relieved again (shown by the fifth arrow 45) and the compressive force approaches zero. The damping element 30 now tends to revert to its initial shape. However, the movement toward this reversion is prevented in that an underpressure P develops in the interior of the annular recess 33 (see fourth arrow 44) which acts against the opening force. This underpressure P is maintained as long as the interior space of the annular recess 33 is sealed. When the opening process has progressed to the extent that the sealing function is no longer ensured, a pressure equilibrium takes place between the atmosphere and the interior space of the annular recess 33. This pressure equilibrium expresses itself through the marked jump 53 in the relief force characteristic 52 shown in FIGS. 5*a* and 5*b*.

Figures 5A, 5B:
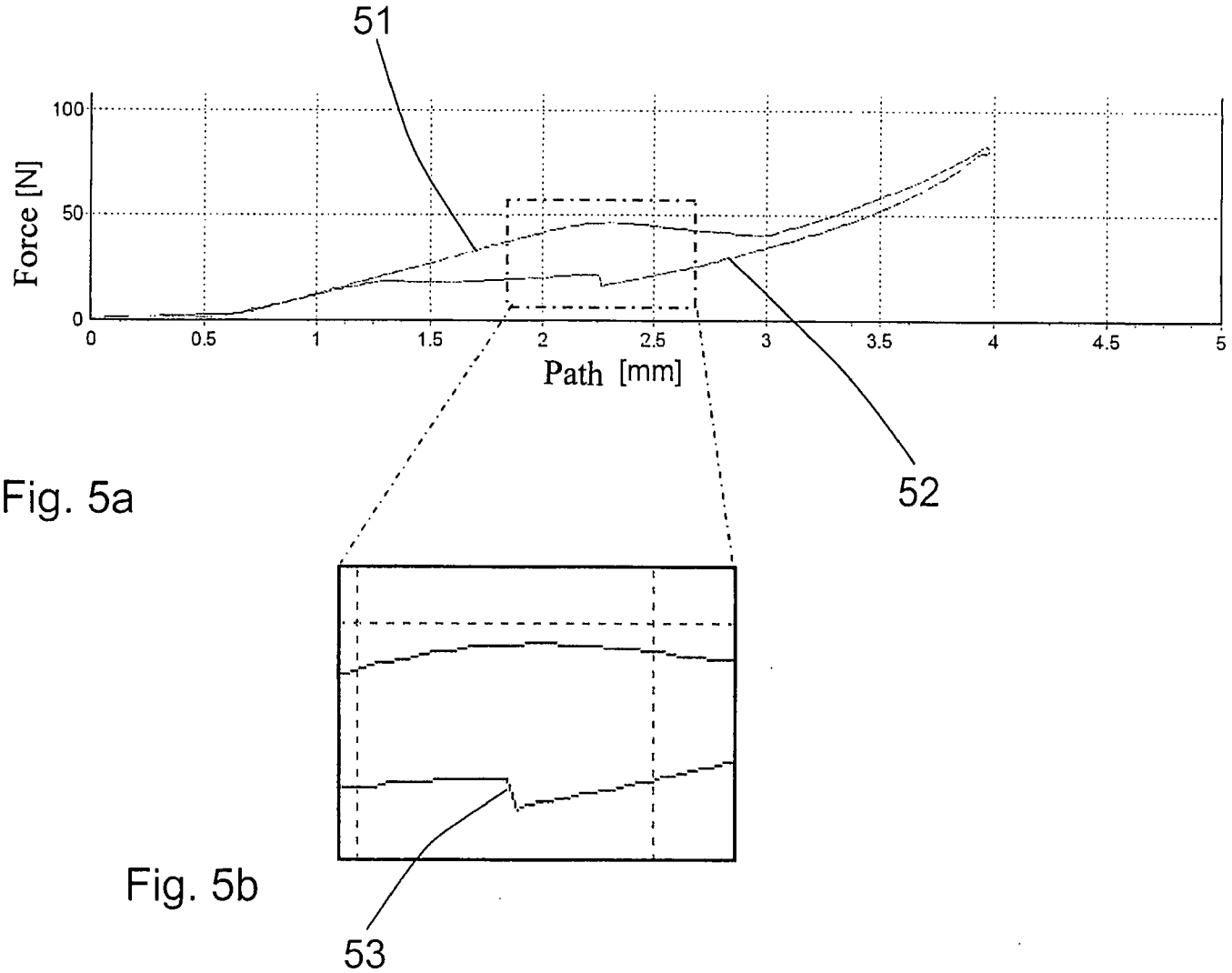
FIG. 5*a* a diagram illustrating the force characteristic of the damping element according to the invention plotted along the compression path with loading and load relief.
FIG. 5*b* a view showing the force characteristic curve at an increased, in comparison with FIG. 5*a*, scale.

Due to the manner of operation of the damping elements 30 described above with reference to FIGS. 4*a* to 4*d*, their force characteristics advantageously exhibit a pronounced hysteresis as can clearly be seen from FIGS. 5*a* and 5*b*. The energy stored by the damping elements 30 due to their deformation is only partially converted into work again because of the hysteresis and the friction at the inner surfaces of the annular recess. The proportion that is not converted again is dissipated in the damping element 30.

Figure 3:
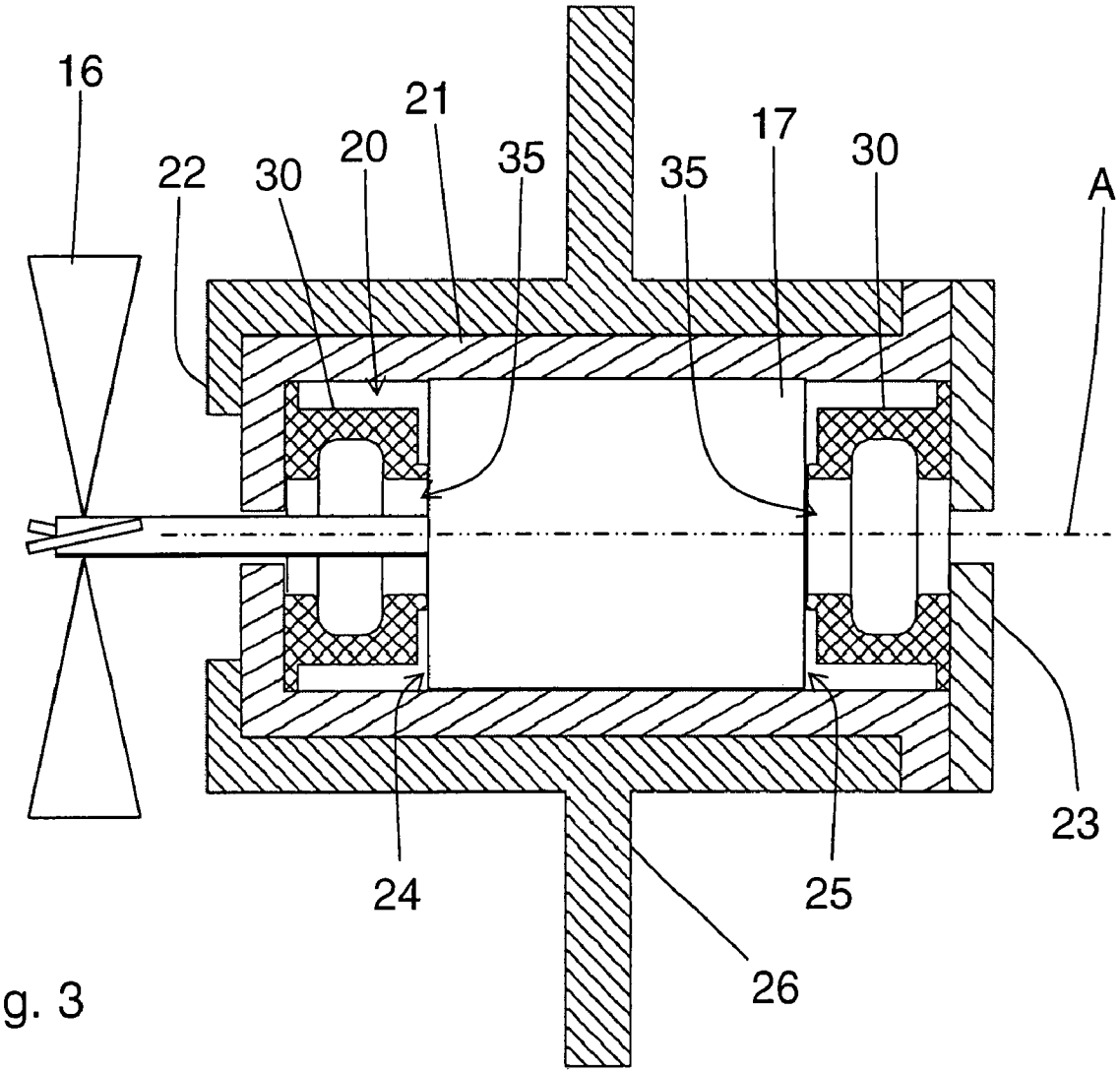
FIG. 3 a detail analogous to that shown in FIG. 2 of another setting tool.

The embodiment of a setting tool according to the invention shown in FIG. 3 differs from those described above only in that the motor-supporting member 21 is formed as a separate sleeve which is fixed in a corresponding recess of a combustion chamber rear wall 26. For further technical details regarding this embodiment, reference is made to the preceding description referring to FIGS. 1 to 5*b*.

Though the present invention was shown and described with references to the preferred embodiments, such are merely illustrative of the present invention and are not to be construed as a limitation thereof and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. A combustion-operated setting tool for driving fastening elements in, comprising a combustion chamber (15); a ventilator (16) located in the combustion chamber (15), a motor (17) for driving the ventilator (16); a motor-supporting member (21) having a receptacle (20) for receiving the motor (17); and an annular damping element (30) located at a wall portion (22, 23), which defines the receptacle (20), for supporting the motor (17) at least at one of axial ends (24, 25) of the motor (17), the damping element (30) having an annular recess (33) formed in a circumference thereof, wherein the damping element has an annular opening (35) and an annular projection (34) provided on a first axial front end side (31) of the damping element immediately adjacent to the annular opening (35).

2. A setting tool according to claim 1, wherein the damping element (30) has a flange (32) provided on a second axial end side thereof opposite the first axial end side of the damping element.

3. A setting tool according to claim 1, wherein the first axial end side (31) of the damping element (30) faces a respective axial end side of the motor (17).

4. A setting tool according to claim 3, wherein an opposite second axial end side of the damping element faces a wall of the receptacle, and wherein the damping element is compressible between the motor (17) and the receptacle (20).

5. A setting tool according to claim 4, wherein air is pressed out of the annular recess (33) of the damping element (30) upon compression thereof.

6. A combustion-operated setting tool for driving fastening elements in, comprising a combustion chamber (15); a ventilator (16) located in the combustion chamber (15); a motor (17) for driving the ventilator (16); a motor-supporting member (21) having a receptacle (20) for receiving the motor (17) and a wall portion (22, 23) for axially limiting the receptacle (20) at one end of the receptacle (20); and an annular damping element (30) located at the wall portion (22, 23) for supporting the motor (17) at a respective axial end surface thereof, the annular damping element (30) having an annular recess (33) formed in a circumference thereof.

7. A setting tool according to claim 6 wherein the annular recess (33) is formed in an inner circumference of the damping element (30).

8. A setting tool according to claim 6, wherein a cross-sectional surface area of the annular recess (33) amounts to from 20% to 60% of a total cross-sectional surface area of the damping element (30).

9. A setting tool according to claim 6, wherein the annular recess (33) has a U-shaped cross-section.

10. A setting tool according to claim 6, wherein a radial depth (T) of the annular recess (33) is less than an axial width (B) of the annular recess (33).

11. A setting tool according to claim 6, the motor (17) is supported at both axial ends thereof (24, 25) in the receptacle (20) by a respective damping element (30).

* * * * *